US008469066B2

(12) United States Patent
Castillo

(10) Patent No.: US 8,469,066 B2
(45) Date of Patent: Jun. 25, 2013

(54) COLLAPSIBLE FUNNEL

(75) Inventor: Brian V. Castillo, Royal Oak, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 139 days.

(21) Appl. No.: 12/915,651

(22) Filed: Oct. 29, 2010

(65) Prior Publication Data

US 2012/0103466 A1 May 3, 2012

(51) Int. Cl.
*B65B 39/00* (2006.01)

(52) U.S. Cl.
USPC ..... 141/338; 141/365

(58) Field of Classification Search
USPC ..... 141/331–335, 337, 338, 363–366
See application file for complete search history.

(56) References Cited

U.S. PATENT DOCUMENTS

| | | | | |
|---|---|---|---|---|
| 1,420,011 | A | 6/1922 | Abbott | |
| 4,256,154 | A | 3/1981 | Black | |
| 5,857,504 | A * | 1/1999 | Tremblay | 141/338 |
| 5,979,516 | A * | 11/1999 | Grant | 141/331 |
| 7,322,386 | B2 * | 1/2008 | Holm | 141/338 |
| 2007/0079897 | A1 * | 4/2007 | Holm | 141/338 |

FOREIGN PATENT DOCUMENTS

DE 1937213 U 4/1966

* cited by examiner

*Primary Examiner* — Jason K Niesz
(74) *Attorney, Agent, or Firm* — Quinn Law Group, PLLC

(57) ABSTRACT

A funnel assembly includes a tube defining a tube passageway and a tube opening. A funnel member defines a first funnel opening, a second funnel opening, and a funnel passageway that provides fluid communication between the first and second funnel openings. The funnel member is positioned such that the second funnel opening is within the tube passageway. The funnel member is selectively movable between a first configuration in which the first funnel opening is wider than the tube opening, and a second configuration in which the first funnel opening is narrower than the tube opening.

14 Claims, 3 Drawing Sheets

COLLAPSIBLE FUNNEL

TECHNICAL FIELD

This invention relates to funnels for transferring liquids into a fill tube.

BACKGROUND

Various devices use a liquid substance for lubrication, the application of hydraulic pressure, cooling, etc. The liquid is typically stored in a chamber formed by a tank, reservoir, sump, etc. Maintenance of the devices may involve adding additional liquid to a chamber. However, chambers may be remotely located from a convenient fill location. Accordingly, a fill tube may be employed to provide a passageway from an inaccessible chamber to an opening at a location that is conveniently accessible.

SUMMARY

A funnel assembly includes a tube defining a tube passageway and a tube opening. A funnel member defines a first funnel opening, a second funnel opening, and a funnel passageway that provides fluid communication between the first and second funnel openings. The funnel member is positioned such that the second funnel opening is within the tube passageway. The funnel member is selectively movable between a first configuration in which the first funnel opening is wider than the tube opening, and a second configuration in which the first funnel opening is narrower than the tube opening.

When the funnel member is in the first configuration, the first funnel opening may function as a fluid inlet; the first funnel opening facilitates the transfer of liquid into the tube because the first funnel opening is wider than the tube opening. Liquid poured into the first funnel opening will be transferred into the tube passageway via the funnel passageway and the second opening, which functions as a funnel outlet.

When the funnel member is in the second configuration, the funnel member is more compact and occupies less volume. In one embodiment, the funnel member, in the second configuration, is stowable within the tube passageway so that the funnel is immediately available at the fill tube for future fill events.

The above features and advantages and other features and advantages of the present invention are readily apparent from the following detailed description of the best modes for carrying out the invention when taken in connection with the accompanying drawings.

DETAILED DESCRIPTION

Figure 1:
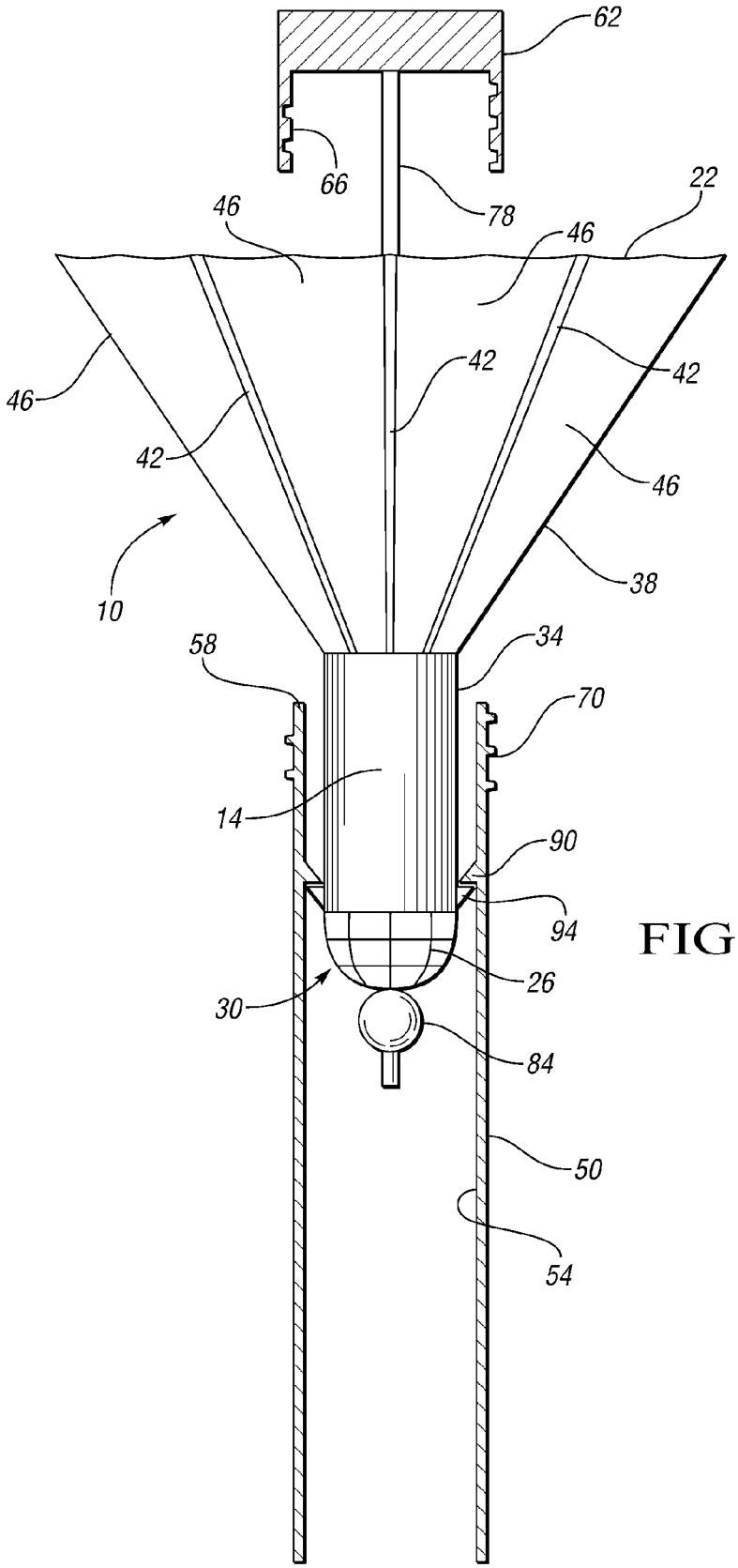
FIG. 1 is a schematic, partial cut-away, side view of a funnel assembly including a funnel member in a first configuration and in a deployed position with respect to a tube.
Figure 2:
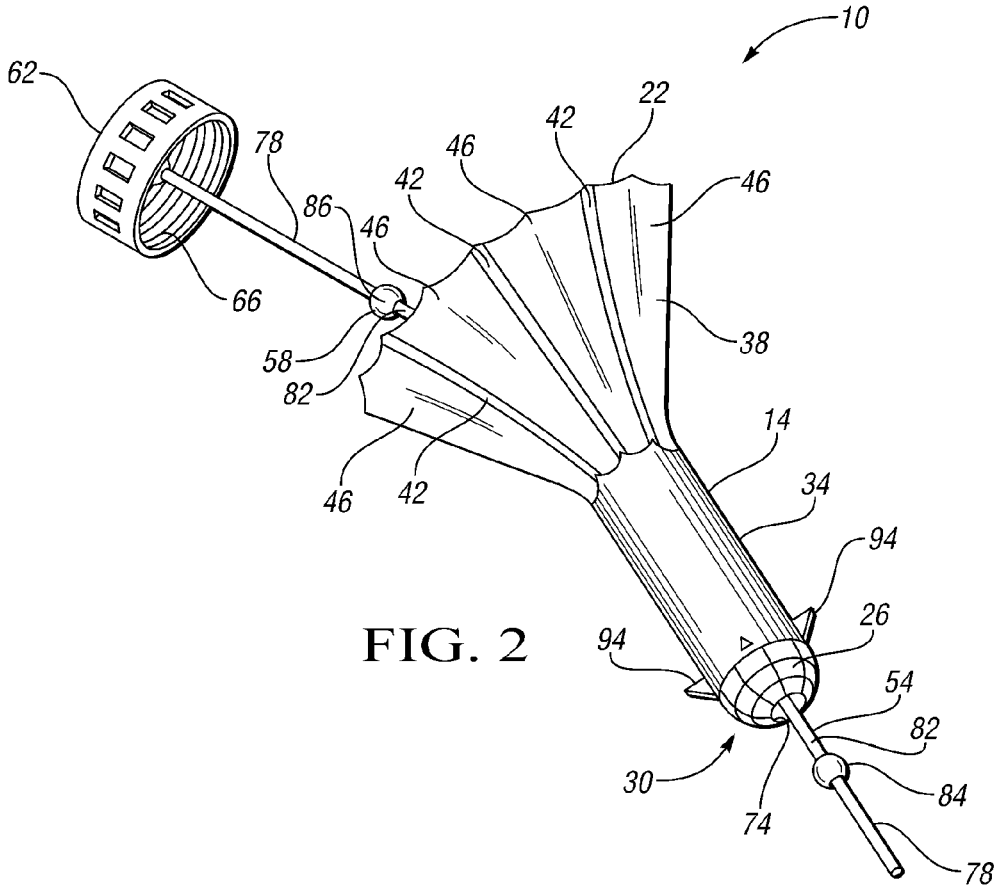
FIG. 2 is a schematic, perspective view of the funnel member of FIG. 1 in the first configuration.
Figure 3:
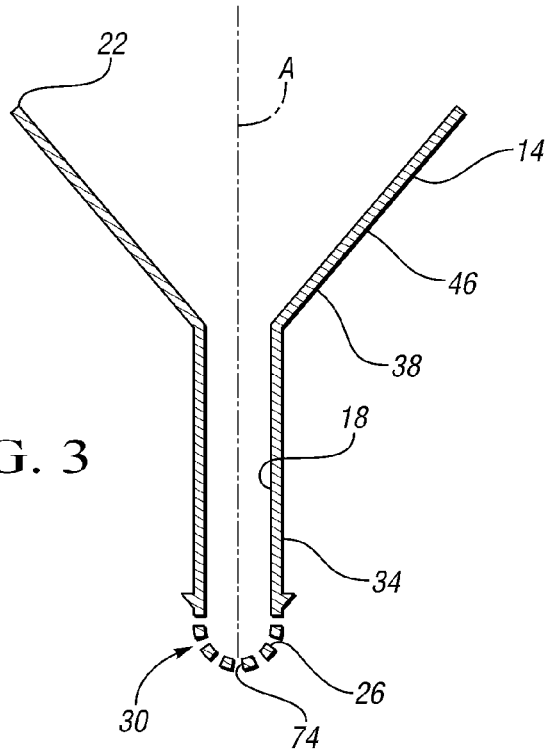
FIG. 3 is a schematic, cross-sectional, side view of the funnel member of FIGS. 1 and 2 in the first configuration.

Referring to FIGS. 1-3, a funnel assembly 10 includes a funnel member 14 defining a passageway 18. The funnel 14 also defines first and second openings 22, 26; the passageway 18 provides fluid communication between the first opening 22 and the second opening 26. The first opening 22 is operable as a fluid inlet, i.e., through which a liquid (not shown) may enter the passageway 18. The second opening 26 is operable as a fluid outlet, i.e., through which the liquid may exit the passageway 18. In the embodiment depicted, the second opening 26 is defined by a mesh portion 30 of the funnel member 14; the mesh portion 30 defines a plurality of holes that may function as outlets.

The funnel member 14 in the embodiment depicted also includes a generally rigid portion 34 and a flexible portion 38. The rigid portion 34 in the embodiment depicted is characterized by a greater stiffness than the flexible portion 38. In the embodiment depicted, the generally rigid portion 34 is cylindrical, and the portion of the passageway 18 defined by the generally rigid portion 34 is cylindrical. The portion of the passageway 18 that is defined by the rigid portion 34 is characterized by a constant diameter along the length of the rigid portion 34. The mesh portion 30 is formed in, or attached to, one end of the rigid portion 34. The flexible portion 38 extends from the other end of the rigid portion 34.

Figure 5:
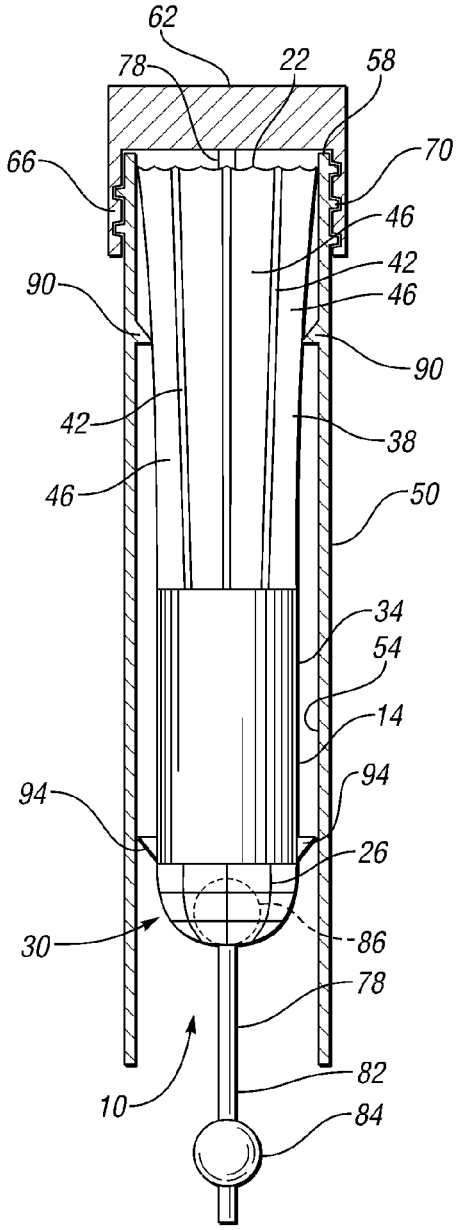
FIG. 5 is a schematic, partial cut-away side view of the funnel assembly of FIG. 1, with the funnel member in a second configuration and in a stowed position with respect to the tube.

The flexible portion 38 includes a plurality of ribs 42 and pleats 46. The ribs 42 extend longitudinally from the rigid portion 34 to the first opening 22. Each of the pleats 46 extends between a respective two ribs 42 from the rigid portion 34 to the first opening 22. The funnel member 14 is movable between a first configuration, as shown in FIGS. 1-3, and a second configuration, as shown in FIG. 5. In the first configuration, the flexible portion 38 is generally frusto-conically shaped. More specifically, the distance between the ribs 42 and the longitudinal axis A of the funnel member 14 increases as a function of distance from the generally rigid portion 34. Similarly, the distance between the pleats 46 and the longitudinal axis A of the funnel member 14 increases as a function of distance from the generally rigid portion 34. Thus, as shown in FIG. 3, the passageway 18 is tapered in the flexible portion 38 such that the first opening 22 is significantly wider than the generally rigid portion 34.

Referring specifically to FIG. 1, the funnel assembly 10 includes a fill tube 50. The fill tube 50 defines a tube passageway 54 having a fill tube opening 58. In the first configuration of the funnel member 14, the first opening 22 is wider than the tube opening 58.

Figure 4:
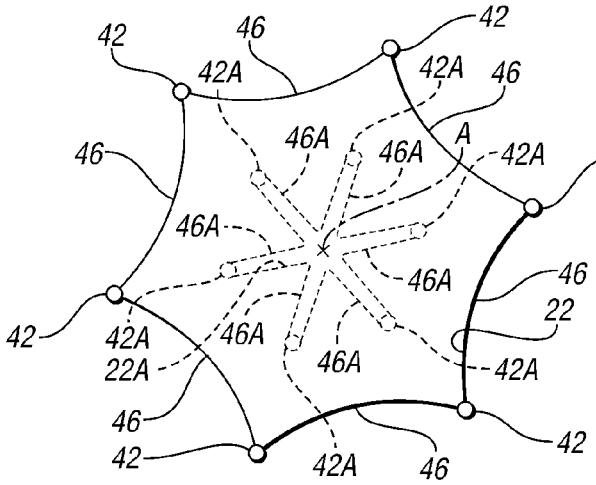
FIG. 4 is a schematic top view of the funnel member of FIGS. 1-3.

In the second configuration, as shown in FIG. 5, the first opening 22 is narrower than the tube opening 58. More specifically, and with reference to FIG. 4, the ribs and pleats in the first configuration are shown at 42 and 46, respectively. The ribs 42 are bendable adjacent the generally rigid portion 34 until the ribs are generally parallel with the longitudinal axis A (as shown in phantom at 42A) and with the wall of the generally rigid portion 34. Correspondingly, the pleats fold between the ribs to the positions shown in phantom at 46A. When the ribs and pleats are at the positions shown in phantom at 42A and 46A, the funnel member 14 is in the second configuration. As shown in FIG. 4, when the funnel member 14 is in the second configuration, the first opening (shown at 22A) is smaller than the opening in the first configuration (as shown at 22). The maximum width of the flexible portion 38 (and opening 22) is less than the fill tube opening 58 and the passageway 54, which enables the full insertion of the funnel member 14 into the fill tube 50.

Referring again to FIG. 1, the funnel member 14 is shown in a deployed position with respect to a fill tube 50 in FIG. 1. In the embodiment depicted, the passageway 54 is cylindrical, and has a larger diameter than the outer diameter of the generally rigid portion 34 of the funnel member 14. When the funnel member 14 is in the deployed position with respect to the fill tube 50, part of the funnel member 14 is disposed within the passageway 54. More specifically, in the embodiment depicted, the mesh portion 30, and therefore the second opening 26, is disposed inside the passageway 54 when the funnel member 14 is in the deployed position. Also, in the embodiment depicted, when the funnel member 14 is in the deployed position, the generally rigid portion 34 extends from the passageway 54 through the fill tube opening 58 such that at least a portion of the generally rigid portion 34 is outside the passageway 54.

When the funnel member 14 is in the deployed position, the flexible portion 38 is outside the passageway 54 of the fill tube 50, and thus the first opening 22 is also outside the fill tube 50. Liquid poured into the funnel passageway 18 via the first opening 22 is directed by the funnel member 14 into the passageway 54 of the fill tube 50 via the second opening 26. The funnel member 14 in the deployed position and in the first configuration facilitates the transfer of liquid from a container (not shown) to the passageway 54 because the first opening 22 is wider than the opening 58 of the fill tube 50.

The funnel member 14 is movable from the deployed position to a stowed position with respect to the fill tube 50, as shown in FIG. 5. Referring to FIG. 5, when the funnel member 14 is in the stowed position, more of the funnel member 14 is disposed within the passageway 54 than in the deployed position. In the embodiment depicted, all of the funnel member 14, including the first opening 22, is disposed within the passageway 54. In order to fit within the passageway 54, the funnel member 14 is moved to the second configuration in which the flexible portion 38, including the opening 22, is collapsed such that the maximum width of the flexible portion 38 is less than the diameter of the passageway 54.

Referring to FIGS. 1, 2, and 5, the funnel assembly 10 includes a cap 62 that is selectively engageable with the tube 50 to obstruct the tube opening 58 (as shown in FIG. 5). More specifically, in the embodiment depicted, the cap 62 defines a plurality of internal threads 66 that are engageable with a plurality of external threads 70 formed on the tube 50. Other forms of engagement between the cap 62 and the tube 50 may be employed within the scope of the claimed invention. For example, the cap 62 may be configured for snap-fit engagement with the end of the tube 50. The cap 62 is operatively connected to the funnel member 14 such that sufficient movement of the cap 62 causes the funnel member 14 to move from the stowed position to the deployed position.

More specifically, the funnel member 14 defines a hole 74 through which a tether 78 extends. The tether 78 is mounted with respect to the cap 62 and is characterized by a narrow portion 82 that is narrower than the hole 74 through which it extends. The tether 78 also includes a first enlarged portion 84 that is larger than the hole 74 and that is disposed such that the hole 74 is between the first enlarged portion 84 and the cap 62. The tether 78 also has a second enlarged portion 86 between the hole 74 and the cap 62. The second enlarged portion 86 is larger than the hole 74. Accordingly, the narrow portion 82 may pass through the hole 74, which enables the cap 62 to move relative to the funnel member 14. The first and second enlarged portions 84, 86 cannot pass through the hole 74, and thus the range of motion of the cap 62 relative to the funnel member 14 is limited by the enlarged portions 84, 86.

As the cap 62 is removed from the tube 50, the narrow portion 82 of the tether 78 passes through the hole 74 until the first enlarged portion 84 contacts the mesh portion 30, as shown in FIG. 1. When the funnel member 14 is in the stowed position, further movement of the cap 62 away from the tube 50 causes the funnel member 14 to move to its deployed position. That is, motion is transferred from the cap 62 to the funnel member 14 via the tether 78 and the first enlarged portion 84 until the funnel member 14 is in the deployed position. Complete removal of the funnel member 14 from the passageway 54 is prevented by physical part interference between protuberance 90 and protuberances 94.

More specifically, the tube 50 is characterized by protuberance 90, or first stop portion, in the surface that defines the passageway 54, which results in a localized narrowing of the passageway 54. The funnel member 14 is characterized by a plurality of protuberances 94, or second stop portion, which results in a localized widening of the generally rigid portion 34. The protuberances 90, 94 are sufficiently positioned such that protuberance 90 contacts protuberances 94 when the funnel member 14 is in the deployed position (as shown in FIG. 1), thereby preventing further outward movement of the funnel member 14. That is, the protuberances 90, 94 prevent complete removal of the funnel member 14 from the tube passageway 54.

Sufficient movement of the cap 62 will also cause the funnel member 14 to move from the deployed position to the stowed position. The tether 78 is flexible, but is sufficiently rigid to carry a compressive load. As the cap 62 is moved toward the tube opening 58 for engagement therewith, the tether 78 moves through the hole 74 relative to the funnel member 14 until the second enlarged portion 86 contacts the funnel member 14. Interference between the second enlarged portion 86 and the funnel member 14 causes motion to be transmitted from the cap 62 to the funnel member 14, which urges the funnel member 14 toward its stowed position.

In the embodiment depicted, the funnel member 14 is characterized by one-piece construction; however, multiple pieces may be used to construct a funnel member within the scope of the claimed invention. In one embodiment, the funnel member 14 is comprised of polypropylene.

While the best modes for carrying out the invention have been described in detail, those familiar with the art to which this invention relates will recognize various alternative designs and embodiments for practicing the invention within the scope of the appended claims.

The invention claimed is:

1. A funnel assembly comprising:

a tube defining a tube passageway and a tube opening;

a funnel member being at least partially disposed within the tube passageway, and defining a first funnel opening, a second funnel opening, a hole, and a funnel passageway that provides fluid communication between the first and second funnel openings;

wherein the funnel member includes:

a flexible portion having a plurality of ribs and a plurality of pleats operatively interconnecting the ribs;

wherein the pleats at least partially define the funnel passageway;

a rigid portion;

wherein the second funnel opening is defined at one end of the rigid portion and the flexible portion extends from the other end of the rigid portion; and a mesh portion disposed at the other end of the rigid portion such that the rigid portion is disposed between the flexible portion and the mesh portion;

wherein the second opening is defined by the mesh portion;

wherein the funnel member is selectively movable between a first configuration in which the first funnel opening is wider than the tube opening, and a second configuration in which the first funnel opening is narrower than the tube opening; and a tether including a narrow portion, a first enlarged portion, and a second enlarged portion;

wherein the narrow portion extends through the hole such that the hole is disposed between the first and second enlarged portions; and wherein the first and second enlarged portions are bulbous in shape.

2. The funnel assembly of claim 1, wherein the funnel member is selectively movable between a deployed position in which the first funnel opening is outside the tube passageway and the second funnel opening is inside the tube passageway, and a stowed position in which the first funnel opening and the second funnel opening are inside the tube passageway.

3. The funnel assembly of claim 2, further comprising a cap that is selectively engageable with the tube to obstruct the tube opening;

wherein the cap is operatively connected to the tether such that sufficient movement of the cap causes the funnel member to move from the stowed position to the deployed position.

4. The funnel assembly of claim 3, wherein the tether is mounted with respect to the cap;

such that the hole is between the first enlarged portion and the cap.

5. The funnel assembly of claim 4, wherein the second enlarged portion is between the hole and the cap.

6. The funnel assembly of claim 2, wherein the tube includes a first stop portion and the funnel member includes a second stop portion; and wherein the first stop portion is sufficiently positioned to contact the second stop portion when the funnel is in the deployed position and thereby prevent removal of the funnel member from the tube passageway.

7. A funnel assembly for use with a tube defining a tube passageway and a tube opening, the funnel member comprising:

a funnel member defining a first funnel opening, a second funnel opening, a hole, and a funnel passageway that provides fluid communication between the first and second funnel openings;

wherein the funnel member includes:

a flexible portion having a plurality of ribs and a plurality of pleats operatively interconnecting the ribs;

wherein the pleats at least partially define the funnel passageway;

a rigid portion;

wherein the second funnel opening is defined at one end of the rigid portion and the flexible portion extends from the other end of the rigid portion; and a mesh portion disposed at the other end of the rigid portion such that the rigid portion is disposed between the flexible portion and the mesh portion;

wherein the second opening is defined by the mesh portion;

wherein the funnel member is selectively movable between a first configuration in which the first funnel opening is wider than the tube opening, and a second configuration in which the first funnel opening is narrower than the tube opening; and a tether including a narrow portion, a first enlarged portion, and a second enlarged portion;

wherein the narrow portion extends through the hole such that the hole is disposed between the first and second enlarged portions; and wherein the first and second enlarged portions are bulbous in shape.

8. The funnel assembly of claim 7, further comprising a cap that is operatively connected to the tether of the funnel member and that is engageable with the tube to obstruct the tube opening.

9. The funnel assembly of claim 8, wherein the tether is mounted with respect to the cap;

such that the hole is between the first enlarged portion and the cap.

10. The funnel assembly of claim 9, wherein the second enlarged portion is between the hole and the cap.

11. The funnel assembly of claim 1, wherein the mesh portion extends from the rigid portion in a dome shape.

12. The funnel assembly of claim 1, wherein the rigid member is cylindrical; and wherein the funnel passageway defined by the rigid portion is characterized by a constant diameter along a length of the rigid portion.

13. The funnel assembly of claim 7, wherein the mesh portion extends away from the rigid portion in a dome shape.

14. The funnel assembly of claim 7, wherein the rigid member is cylindrical; and wherein the funnel passageway defined by the rigid portion is characterized by a constant diameter along a length of the rigid portion.

* * * * *